US006090260A

United States Patent [19]

Inoue et al.

[11] Patent Number: 6,090,260

[45] Date of Patent: Jul. 18, 2000

[54] ELECTROPLATING METHOD

[75] Inventors: Satoshi Inoue; Toyoaki Tanaka, both of Nagano; Yoshiro Nakagawa, Yamanashi, all of Japan

[73] Assignee: TDK Corporation, Tokyo, Japan

[21] Appl. No.: 09/048,328

[22] Filed: Mar. 26, 1998

[30] Foreign Application Priority Data

Mar. 31, 1997 [JP] Japan ..... 9-094518

[51] Int. Cl.[7] ..... C25D 5/10; C25D 21/12

[52] U.S. Cl. ..... 205/102; 205/96; 205/105; 205/106; 205/119; 205/176; 205/917; 205/918

[58] Field of Search ..... 205/90, 96, 97, 205/102, 105, 106, 119, 176, 917, 918

[56] References Cited

U.S. PATENT DOCUMENTS 4,563,399 1/1986 Wright, Jr. ..... 428/628

5,374,344 12/1994 Gall et al. ..... 205/96

FOREIGN PATENT DOCUMENTS 63-111196 5/1988 Japan .

4-66698 3/1992 Japan .

*Primary Examiner*—Kathryn Gorgos

*Assistant Examiner*—William T. Leader

*Attorney, Agent, or Firm*—Armstrong, Westerman, Hattori, McLeland & Naughton

[57] ABSTRACT

A method of electroplating an object to be plated attached to a lower portion of a plating bath constituted by draining used plating solution and supplying new plating solution at every plating procedure. The method has a step of supplying additional current so that the object to be plated always has cathode potential, while the object to be plated is being dipped in the plating bath and electroplating is not carried out.

5 Claims, 6 Drawing Sheets

ELECTROPLATING METHOD

1. Field of the Invention

The present invention relates to a method and apparatus for electroplating a substrate of electronic components, an IC wafer, a wafer of thin film magnetic heads and other substrates.

2. Description of the Related Art

During electroplating, in order to prevent an abnormally plated surface from forming, an anode electrode is arranged at the upper portion of a plating tank and an object to be plated is arranged at the lower portion of the tank so that the surface to be plated faces upwardly. If the surface to be plated is faced downwardly, hydrogen, which is generated from the cathode, may contact the surface to be plated causing abnormality of plated surface to occur.

Therefore, this kind of plating processes is carried out by a so-called batch procedure consisting of removing the plating solution from the tank at every completion of plating, supplying the plating solution again to fill the tank therewith after attaching a new object to be plated to the lower portion in the tank, and supplying plating current.

In order to allow uniform distribution of current density in a plating area so that the composition and thickness of a layer formed by plating (hereinafter called as a plated layer) can be uniform, a ring-shaped cathode electrode which comes into face contact with a peripheral portion of the object to be plated is also provided (Japanese unexamined patent publication No.(1992)4-66698).

However, according to the above-mentioned conventional method, the following problems occur when a batch procedure is carried out.

(1) An electrode film on the object to be plated, for flowing there through the plating current to the object, is etched while the plating solution is being supplied to the tank before plating.

(2) A plated layer formed on the object by plating is etched while the plating solution is being discharged after plating.

SUMMARY OF THE INVENTION

It is therefore an object of the present invention to provide an electroplating method and apparatus whereby, when electroplating is carried out by a batch procedure, corrosion of an electrode film for passing plating current and of a plated layer on an object, which occurs in an off-state of plating electricity, can be prevented.

According to the present invention, a method of electroplating an object to be plated attached to a lower portion of a plating bath constituted by draining used plating solution and supplying new plating solution at every plating procedure is provided. The method has a step of supplying additional current so that the object to be plated always has cathode potential, while the object to be plated is being dipped in the plating bath and electroplating is not carried out.

According to the inventors of this application, the reason why an electrode film to conduct plating current to an object to be plated and a plated layer on the object are corroded during no current flowing, in case an electroplating of the object is carried out by a batch procedure, have been found as follows. (1) Potential difference is generated between the object to be plated and cathode electrode while the object is anode potential, and (2) the plating solution itself is acidic (pH 2 to 3). Thus, according to the present invention, while the object to be plated is being dipped in a plating bath and no electroplating is carried out, additional current is supplied so that the object always has cathode potential in the plating bath. Consequently, no possibility of corrosion of the electrode film and the plated layer during no current supply occurs. Furthermore, variation of the thickness of a plated layer due to the corrosion can be drastically decreased, whereby film thickness controllability is largely improved.

Japanese unexamined patent publication No.(1988)63-111196 discloses a technique for preventing, in a horizontal continuous plating line for a steel sheet, melting of the upper plated layer by supplying current so that the electric potential of the steel sheet is kept negative with respect to that of the additional electrode. However, this technique aims to equalize the plating current for the upper plating surface with the plating current for the lower plating surface in the continuous plating process of steel sheets, and therefore there is no teaching for preventing corrosion occurring during no current supply in the batch procedure as in the present invention.

While electroplating is being carried out, additional current may be supplied or may not be supplied.

It is preferred that the additional current is direct current which is supplied from at least one additional electrode provided near the object to be plated in the plating bath in the direction of the object through the plating bath.

It is further preferred that the additional current is direct current with a current density of 0.01 to 0.1 $A/dm^2$ (1 $A/dm^2$=10 $mA/cm^2$).

According to the present invention, an apparatus for electroplating an object to be plated is provided. The apparatus has a plating tank, a main anode electrode provided in the plating tank, a cathode electrode connected to the object to be plated and attached to a lower portion of the plating tank, a plating bath constituted by draining used plating solution and supplying new plating solution at every plating procedure, at least one additional anode electrode provided near the object to be plated in the plating tank, and an additional current source for supplying an additional current so that the object to be plated always has cathode potential, while the object to be plated is being dipped in the plating bath and electroplating is not carried out.

While the electroplating is being carried out, the additional current may be supplied or may not be supplied.

It is preferred that the additional current source is a source for supplying additional direct current with a current density of 0.01 to 0.1 $A/dm^2$.

It is also preferred that the at least one additional current source includes a plurality of additional anode electrodes located around the cathode electrode with a space therebetween. In this case, the additional anode electrodes may be located on the diagonal line of a bottom surface of the plating tank so as to sandwich the cathode electrode between them.

It is preferred that the at least one additional anode electrode is composed of platinum, nickel or titanium.

The cathode electrode is preferably composed of a metallic material with an ionization tendency larger than that of a metallic material of an electrode film to conduct plating current to the object to be plated.

It is one of embodiments of the present invention that the object to be plated is a wafer for thin film magnetic heads.

Further, objects and advantages of the present invention will be apparent from a description of the preferred embodiments of the invention as illustrated in the accompanying drawings.

DESCRIPTION OF THE PREFERRED EMBODIMENTS

Figure 1:
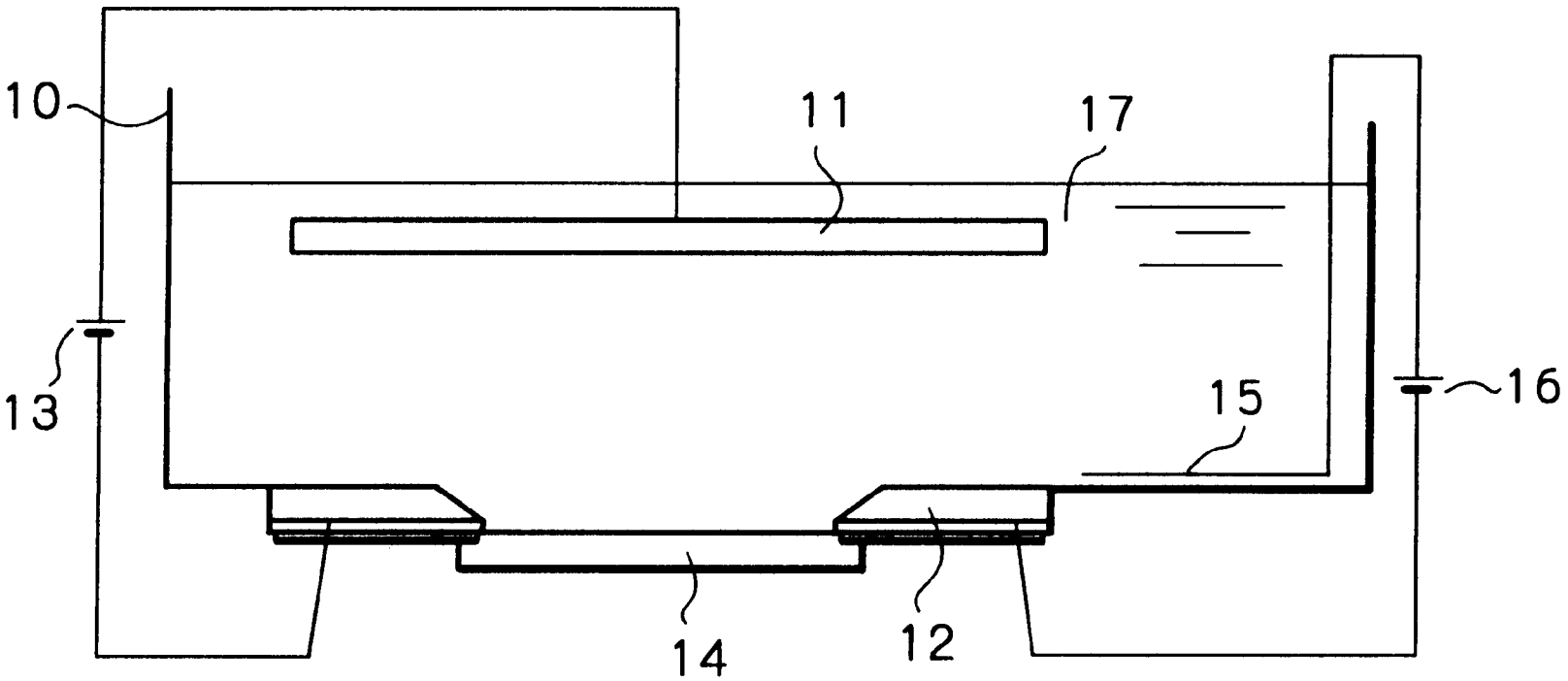
FIG. 1 is a schematic view illustrating an embodiment of an electroplating apparatus according to the present invention.

An embodiment illustrated in FIG. 1 is an electroplating apparatus in which a batch procedure for producing a metallic layer containing Fe in, for example, NiFe, CoNiFe, CoFe or the like, on a wafer of thin film magnetic heads is carried out.

In FIG. 1, reference numeral 10 denotes a plating tank, 11 a main anode electrode provided at the upper portion in the tank 10, 12 a ring-shaped cathode electrode provided at the bottom portion of the tank 10, and 13 a main current supply source connected between the main anode electrode 11 and the cathode electrode 12. A wafer 14 is attached to the cathode electrode 12 from the outside so that the wafer surface to be plated is faced upwardly, whereby the peripheral portion of the wafer 14 is electrically connected to the cathode electrode 12 with surface contact. Near the cathode electrode 12 and above the bottom surface of the plating tank 10, two additional anode electrodes 15 positioned on the diagonal line of the bottom surface of the tank 10 are provided. Between each of the additional anode electrodes 15 and the cathode electrode 12 is connected an additional current source 16 for supplying additional current. This source 16 supplies an additional direct current so that the wafer 14 has always cathode potential to a plating bath while the wafer 14 is being dipped in the plating bath.

When a metallic layer of 45 NiFe (45% Ni and 55% Fe by weight) to 80 NiFe (80% Ni and 20% Fe by weight) is to be plated to form the plated layer on the wafer, nickel is used as a material of the main anode electrode 11 in the embodiment. On the other hand, as for a material of the cathode electrode 12, copper is used. However, as for the cathode electrode material, a metallic material with an ionization tendency larger than that of metallic materials of an electrode film formed on the wafer 14 to flow plating current to the wafer and of the layer plated on the wafer 14 is preferably used. As for the additional anode electrodes 15, platinum, nickel or titanium is used in the embodiment.

In order to electroplate a metallic layer of 45 NiFe to 80 NiFe, one of the following two baths is used:

- a NiFe bath containing nickel sulfate, ferrous sulfate, ammonium chloride, boric acid, saccharin sodium and lauryl sodium sulfate, and
- a NiFe bath containing nickel sulfate, ferrous sulfate, nickel chloride, boric acid, saccharin sodium and lauryl sodium sulfate.

Alternatively, in order to plate a metallic layer containing ferrous of CoFe, CoNiFe or the like, a metallic plating bath containing nickel sulfate, ferrous sulfate, cobalt sulfate, ammonium chloride, boric acid, saccharin sodium and lauryl sodium sulfate is used.

Since FIG. 1 shows the electroplating apparatus now plating, the plating bath 17 is in the tank 10. In the actual operation of the batch procedure, plating solution is drained from the tank 10 at every completion of plating, and then a new plating solution is supplied to fill the tank 10 after the plated wafer 14 is replaced with a new one.

FIGS. 2 to 5 schematically illustrate processes of the batch plating procedure.

Figure 2:
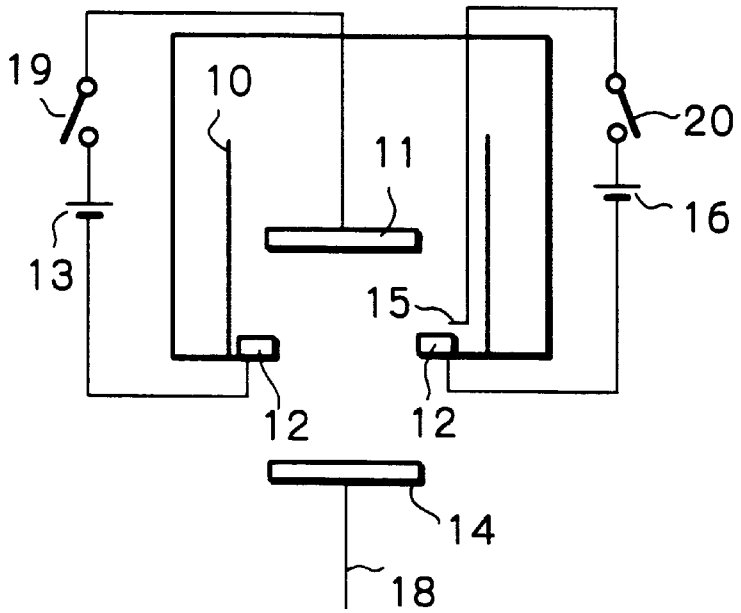
FIG. 2 is an explanatory view schematically illustrating a process of a batch plating procedure in the embodiment of FIG.

As shown in FIG. 2, before plating, the wafer 14 mounted on a supporting cylinder 18 has not yet been attached to the tank 10, and no plating solution is contained in the tank 10. Of course, both a switch 19 for the main current supply and a switch 20 for the additional current supply are kept in an off state.

Figure 3:
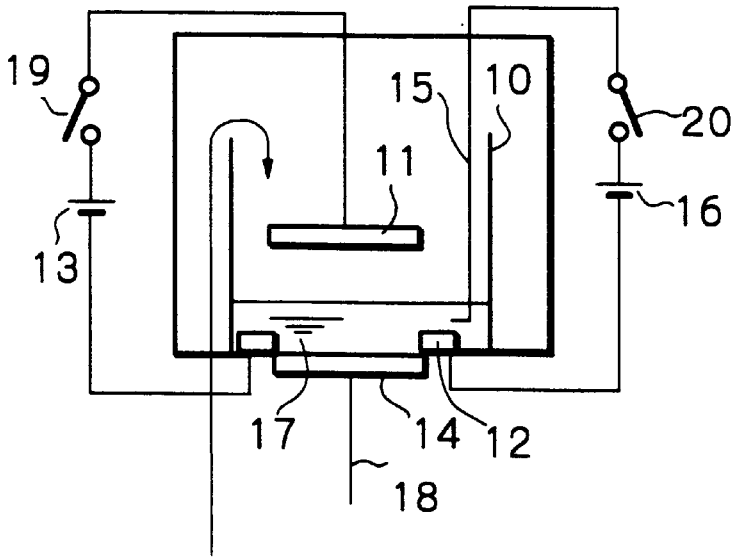
FIG. 3 is an explanatory view schematically illustrating a process of a batch plating procedure in the embodiment of FIG. 1.

FIG. 3 shows a state just at the start of a plating procedure. In this state, the wafer 14 has already been attached to the plating tank 10, and the supply of the plating solution has already been started. That is, in this state, the supporting cylinder 18 mounting the wafer 14 has already been lifted and thus the wafer 14 is sealingly attached to the cathode electrode 12. As a result, an electrode film previously formed on the wafer 14 by vapor deposition, sputtering or the like during the wafer process and the cathode electrode 12 are electrically connected so that a cathode is formed as a whole. However, the switch 19 for the main current supply still remains open and plating has not yet been carried out. When a supplied plating solution (plating bath) 17 is filled in the tank 10 and the wafer 14 is dipped therein, the switch 20 is closed to supply a desired additional direct current from the additional current power supply in the direction of the wafer 14 through the additional anode electrode 15 and the plating bath 17. Thus, the wafer 14 has the cathode potential and the electrode film for supplying plating current is not corroded.

Figure 4:
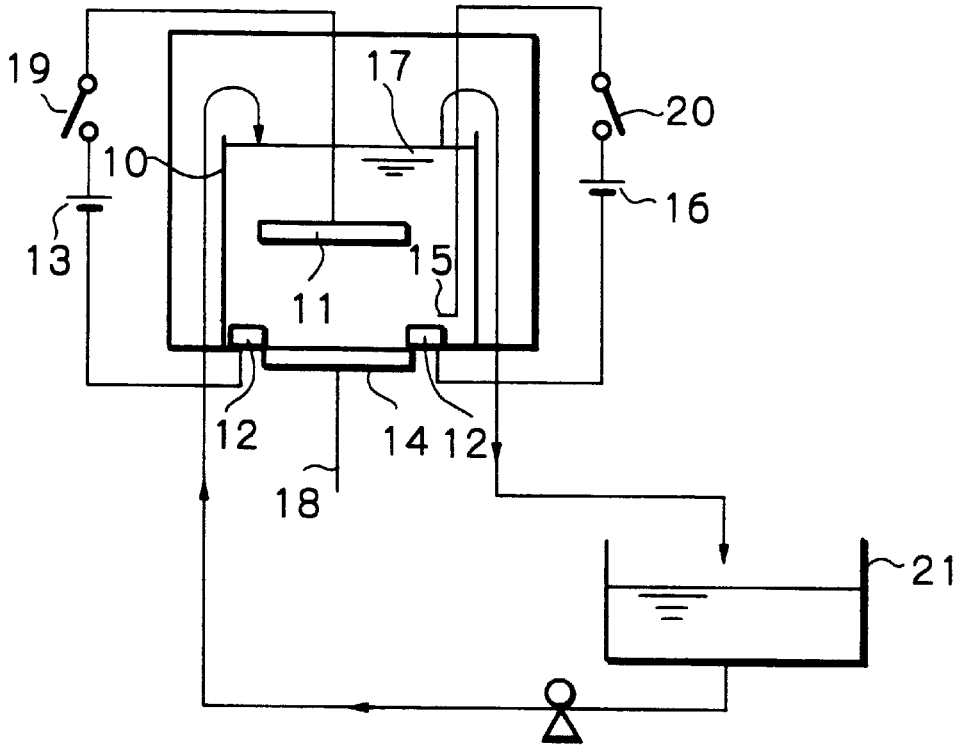
FIG. 4 is an explanatory view schematically illustrating a process of a batch plating procedure in the embodiment of FIG. 1.

FIG. 4 shows a state where plating is being carried out. When the level of the plating solution supplied in the plating tank 10 exceeds the main anode electrode 11, the switch 19 for the main current power supply is closed to start the actual plating operation. In this case, the switch 20 for additional current supply also remains closed. Thus, the additional current is continuously supplied. As apparent from FIG. 4, the plating solution is cycled between the plating tank 10 and a sub tank 21.

Figure 5:
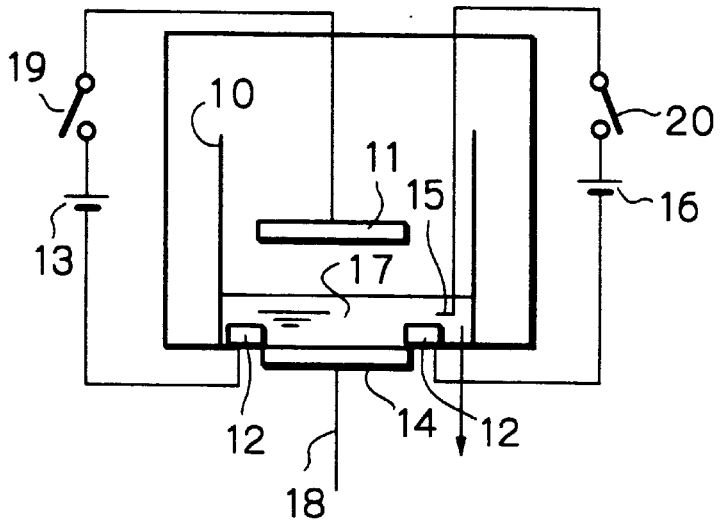
FIG. 5 is an explanatory view schematically illustrating a process of a batch plating procedure in the embodiment of FIG. 1.

FIG. 5 shows a state just before the completion of the plating procedure. In this state, the switch is opened and the plating operation has been completed. However, the wafer 14 still remains attached to the plating tank 10 while the plating solution 17 is being drained. Thus the wafer 14 is being dipped in the plating solution 17 which is now being drained. In this case, the switch 20 is kept in a closed state without exception to supply the additional direct current from the additional anode electrode 15. Thus, the wafer 14 is maintained to be in the cathode potential and there would be no possibility of corrosion of the plated layer by the plating solution 17.

As described above, in this embodiment, the additional current is supplied from the additional anode electrode 15 to the wafer 14 which has a cathode potential, from the time when the plating solution is supplied to the plating tank 10 to dip the wafer 14, until the plating solution 17 is drained so that the wafer 14 is not dipped in the plating solution 17 after the plating operation is completed. Thus, during this period of time, the wafer 14 is maintained at the cathode potential to the plating solution 17, and therefore any corrosion of the electrode film for conducting plating current and the plated layer, caused by the plating solution 17 can be prevented. In general, the more the plated layer contains ferrous composition, the more easily it is corroded by the plating solution. For example, according to the conventional method, if a 50 NiFe (50% Ni and 50% Fe by weight) film is formed by plating, corrosion by a plating solution is a serious problem. However, according to this embodiment, thanks for applying the additional current, such problem of the corrosion can be fully overcome.

In a modification, while the switch 19 for main current supply is in a closed state to actually carry out the plating operation, the switch 20 for additional current supply may be opened to stop the supply of the additional current. In this case, after completion of the plating operation, that is, when the switch 19 of the main current supply is opened, the switch 20 of the additional current supply is immediately closed to supply the additional current.

Figure 6A:
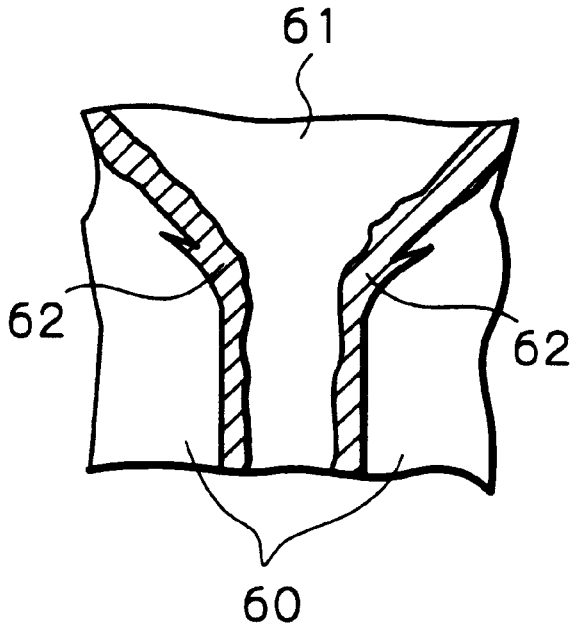
FIGS. 6*a* and 6*b* are diagrammatic sketches of SEM observations in cross-sections with respect to yoke portions of magnetic poles of thin film magnetic heads plated on wafers according to the conventional method and according to the embodiment of FIG. 1, respectively.
Figure 6B:
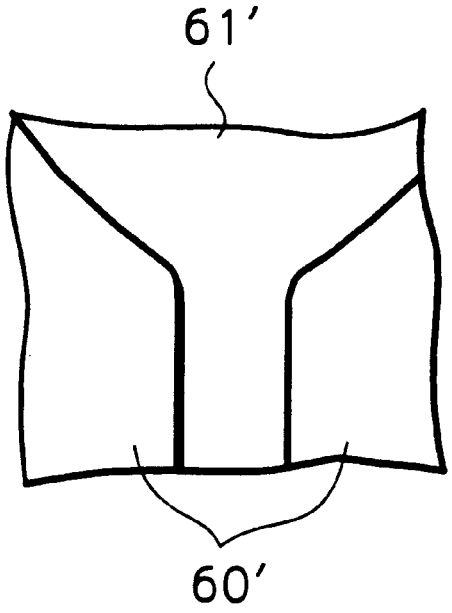

FIGS. 6*a* and 6*b* are diagrammatic sketches of SEM observations in cross-section with respect to yoke portions of magnetic poles of thin film magnetic heads, plated on wafers according to the conventional method and according to this embodiment, respectively. As shown in FIG. 6*a*, according to the conventional method, at the outer peripheral portion of a yoke 61 plated on an insulating layer 60, corroded portions 62 are formed by the plating solution. To the contrary, as shown in FIG. 6*b*, according to the embodiment, there is no corroded portion at the outer periphery portion of the yoke 61' plated on the insulating layer 60'.

Figure 7:
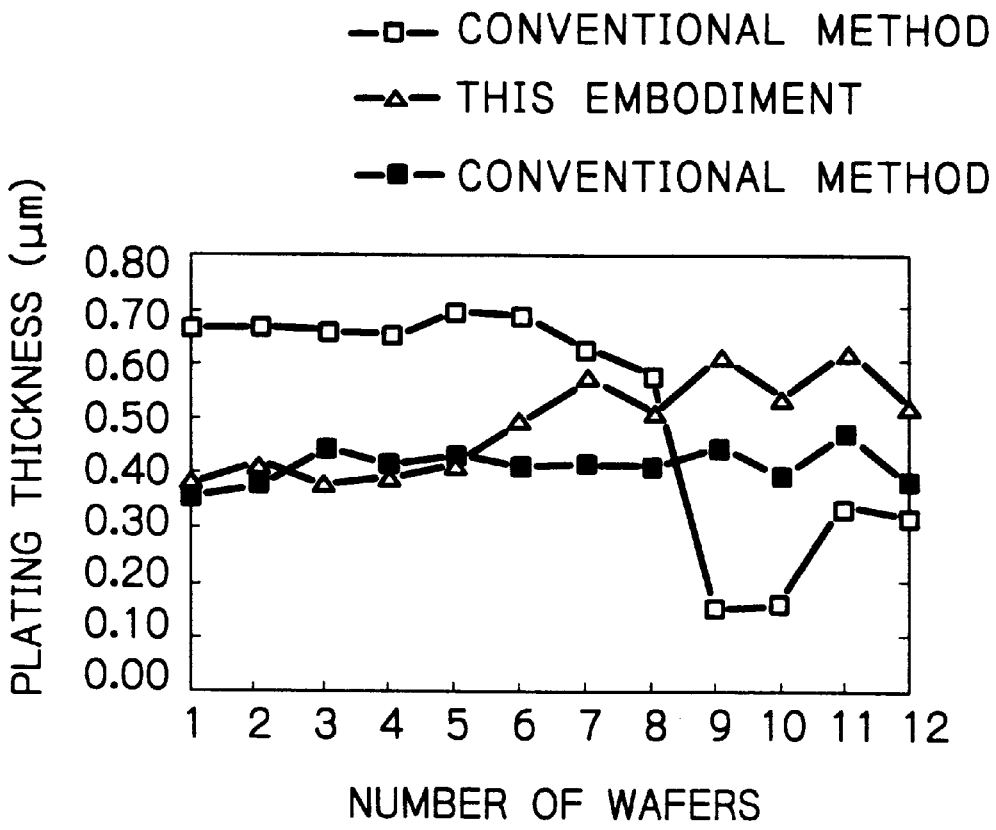
FIG. 7 is a view of film thickness controllability exhibited when plating procedure is carried out according to the conventional method and according to the embodiment of FIG. 1.

As aforementioned, according to this embodiment, not only corrosion of the electrode film for conducting plating current and the plated layer can be prevented, but also variation in the thickness of the plated layer caused by the corrosion can be drastically decreased, whereby film thickness controllability is largely improved. Namely, as shown in FIG. 7, the thickness of the plated layer is largely varied in accordance with the number of plated wafers according to the conventional method. However, according to this embodiment, even if the number of plated wafers is increased, the film thickness can be substantially uniformly maintained.

It is preferred that the additional current to be supplied in the electroplating apparatus of the present invention has a current density of 0.01 to 0.1 A/dm$^2$. Table 1 shows the number of samples in which corrosion has been found by observation using SEM with respect to each of twenty samples plated in different additional currents.

TABLE 1

| Additional Current | less than 0.01 A/dm$^2$ | 0.01 to 0.1 A/dm$^2$ | more than 0.1 A/dm$^2$ |
|---|---|---|---|
| Number of Samples with Corrosion | 16/20 | 0/20 | 0/20 |

When the current density of the additional current is less than 0.01 A/dm$^2$, corrosion due to plating solution occurs. However, no corrosion is found at additional current density equal to or more than 0.01 A/dm$^2$. Nevertheless, when the current density of the additional current is more than 0.1 A/dm$^2$, quantity of another material which is different from metal material to be plated, formed by the additional current, is increased causing properties of a plated layer to deteriorate.

Figure 8:
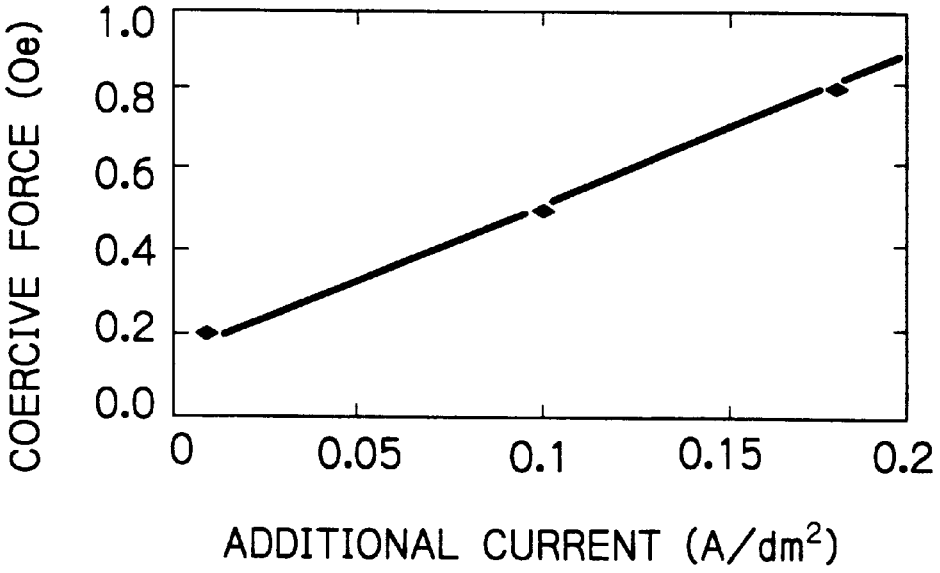
FIG. 8 is a view illustrating coercive force properties to additional current.

It is generally desirable that the magnetic pole of a thin film magnetic head has a small coercive force Hc. However, as apparent from the properties of coercive force with respect to additional current in FIG. 8, coercive force becomes Hc>0.5 when the additional current density exceeds 0.1 A/dm$^2$, thereby exceeding tolerance limits of magnetic properties. Thus, it is desired that the additional current density is equal to or less than 0.1 A/dm$^2$.

In the above-mentioned embodiment, two anode electrodes 15 are provided near the cathode electrode 12. However, in an electroplating apparatus of the present invention, one additional anode electrode may be provided near the cathode electrode, or three or more additional anode electrodes can be formed so that they are arranged around the cathode electrode while providing a space therebetween. By providing the plurality of additional anode electrodes around the cathode electrode with the same space, distribution of current density can be uniform.

Figure 9A:
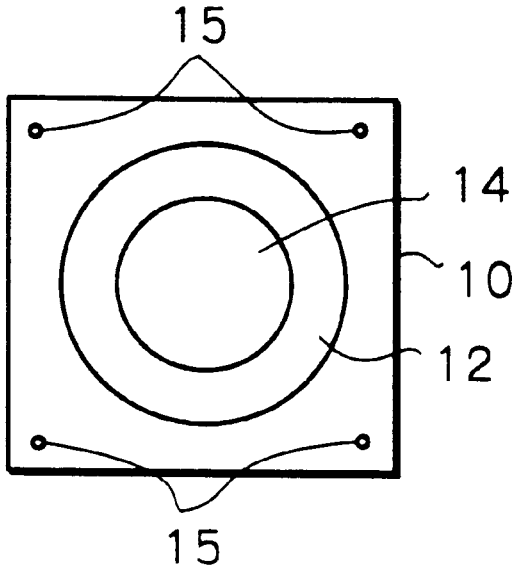
FIGS. 9*a* and 9*b* are a plan view illustrating an example of the additional anode electrode arrangements in which four additional anode electrodes are provided and a side view of FIG. 9*a*, respectively.
Figure 9B:
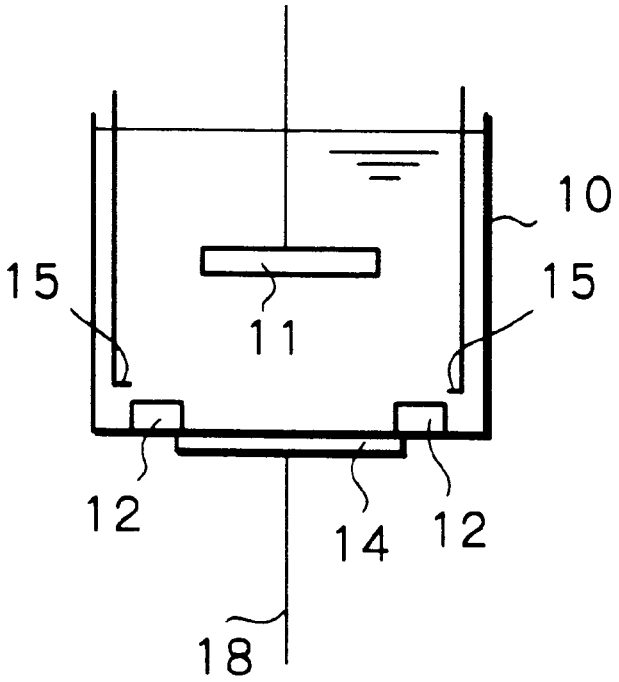

FIGS. 9*a* and 9*b* show an example of an arrangement of these additional anode electrodes in the case where four additional anode electrodes are provided. As apparent from these figures, the four additional anode electrodes 15 are arranged on diagonal lines of the bottom surface of the plating tank 10, concretely on the four corners of the plating tank 10 while sandwiching the cathode electrode 12.

Many widely different embodiments of the present invention may be constructed without departing from the spirit and scope of the present invention. It should be understood that the present invention is not limited to the specific embodiments described in the specification, except as defined in the appended claims.

What is claimed is:

1. A method of electroplating an object comprising the steps of:

providing said object to be plated in a lower portion of a plating tank having a cathode in contact with the object and first and second anodes within the tank and spaced from the object;

supplying a plating solution to said plating tank to immerse said object and said first and second anodes;

supplying current from said first anode so that said object has cathodic potential;

electroplating said object by supplying current from said second anode; and draining used plating solution from the plating tank, the current from said first anode being supplied when said object is immersed in the plating solution at least until the electroplating step.

2. The method as claimed in claim 1, wherein when said electroplating is being carried out, said current from said first anode is supplied.

3. The method as claimed in claim 1, wherein when said electroplating is being carried out, said current from said first anode is not supplied.

4. The method as claimed in claim 1, wherein said current supplied from said first anode is direct current and said first anode is provided nearer said object to be plated in said plating tank than said second anode.

5. The method as claimed in claim 1, wherein said current supplied from said first anode is direct current with a current density of 0.01 to 0.1 $A/dm^2$.

* * * * *